United States Patent [19]

Battistella et al.

[11] Patent Number: 5,060,403

[45] Date of Patent: Oct. 29, 1991

[54] ADJUSTABLE CLOSURE DEVICE PARTICULARLY FOR SKI BOOTS

[75] Inventors: Mirco Battistella, Breda di Piave; Roberto Gorza, Feltre, both of Italy

[73] Assignee: Nordica S.p.A., Montebelluna, Italy

[21] Appl. No.: 571,698

[22] Filed: Aug. 24, 1990

[30] Foreign Application Priority Data

Aug. 31, 1989 [IT] Italy ..... 82578 A/89

[51] Int. Cl.[5] ..... A43B 5/04

[52] U.S. Cl. ..... 36/117; 36/119; 36/121

[58] Field of Search ..... 36/117, 118, 119, 120, 36/121

[56] References Cited

U.S. PATENT DOCUMENTS

| | | | |
|---|---|---|---|
| 4,581,831 | 4/1986 | Kirsch | 36/119 |
| 4,601,117 | 7/1986 | Leonardi | 36/120 |
| 4,653,204 | 3/1987 | Morell et al. | 36/117 |
| 4,694,592 | 9/1987 | Baggio et al. | 36/117 |
| 4,885,850 | 12/1989 | Sartor et al. | 36/119 |

FOREIGN PATENT DOCUMENTS

| | | | |
|---|---|---|---|
| 0226857 | 7/1987 | European Pat. Off. | 36/119 |
| 0281051 | 9/1988 | European Pat. Off. | 36/117 |
| 0307349 | 3/1989 | European Pat. Off. | 36/117 |
| 3504002 | 8/1986 | Fed. Rep. of Germany | 36/117 |
| 3834037 | 4/1989 | Fed. Rep. of Germany | 36/117 |
| 8705473 | 9/1987 | World Int. Prop. O. | 36/117 |

*Primary Examiner*—Paul T. Sewell
*Assistant Examiner*—Marie D. Patterson
*Attorney, Agent, or Firm*—Guido Modiano; Albert Josif

[57] ABSTRACT

The adjustable closure device includes a tensioning means, such as a lever, for actuating a cable adapted to tighten the front and rear quarters of the ski boot; the front quarter has a stop element for engaging the front quarter with the shell when the skier extends his/her leg; a release means is provided for releasing the stop element disengaging the front quarter from the shell and thus obtaining a walking position.

20 Claims, 2 Drawing Sheets

ADJUSTABLE CLOSURE DEVICE PARTICULARLY FOR SKI BOOTS

BACKGROUND OF THE INVENTION

The present invention relates to an adjustable closure device particularly for ski boots of the rear-entry type.

A strongly felt problem, in known rear-entry ski boots, is that of providing a safe and correct fastening of the quarters and of allowing the skier to walk comfortably when the skis are removed.

Most known ski boot closure devices have a lever adapted to tension one or more cables for closing the quarters; when the lever is opened the quarters are in fact released completely, and the boot may easily slip off when walking.

As a partial solution to this disadvantage, boots are known which have quarter closure means such as transversely arranged bands; the rear quarter then has means which temporarily interact with the shell, and the activation or non-activation of these means allows to free the quarters in their rotation with respect to the axis of pivoting to said shell.

Though better walking is allowed in this manner by virtue of the rotation which the quarters can perform with respect to the shell, it is observed that said quarters are tightly closed, and therefore uncomfortable for the skier.

U.S. Pat. No. 4,581,831 discloses a foot instep closure device which is also adapted to lock the front quarter to the shell in a vorlage position; the device can be released for walking allowing the quarter to rotate with respect to the shell.

Also this device, though, has the above mentioned disadvantages, and it is furthermore structurally very complicated and bulky.

U.S. Pat. No. 4,551,933 discloses a rear-entry ski boot provided with elastic elements interposed between the quarters for the automatic closure thereof consequent to a given voluntary motion which is performed by the skier and is adapted to release the rear quarter from adapted grip means.

This boot also has the previously mentioned disadvantage of being uncomfortable when walking because it can easily slip off.

As regards the feature of tightening the quarters of a boot when flexing the leg, this same Applicant filed a U.S. Pat. application Ser. No. 06/936,865, disclosing a ski boot with a foot securing device the peculiarity whereof consists of the fact that it comprises a traction element for locking the foot inside the shell which is connected to traction means for varying the working length of the traction element inside the shell which can be activated by the oscillation of the quarter with respect to the shell; said traction means are provided with a stop element which can be actuated for the operative disengagement from the oscillation of the quarter, and means are furthermore provided for the removable locking of the loosening of the traction element.

This solution allows to move, by flexing the leg forward a few times, a toothed band toward the tip of the boot and consequently to tension the cables around the heel from the foot instep.

In this solution, however, while the locking devices can be actuated without performing the securing directly with one's hand, there still are the disadvantages related to the skier's easy walking.

U.S. Pat. No. 4,735,004, filed on Apr. 17, 1987, discloses a ski boot which has a device for the closure of the quarters interposed between the front quarter and the shell.

This device, which is also used for the automatic closure of the quarters, however has numerous disadvantages, such as a considerable size and a structural complexity, and significantly alters the styling of the boot.

The considerable structural complication of the device furthermore makes it scarcely reliable and increases its production costs.

Furthermore, the flexibility which can be achieved by means of a resilient element inside the device is minimal and in any case cannot be adjusted.

U.S. Pat. No. 4,499,676 discloses a ski boot having a rocker for locking the rear quarter in a running downhill position. The rocker can be released for straightening the quarter for a walking position.

In this ski boot the quarter fastening means are independent from the rocker and therefore the quarters are not untightened when the rocker is in the walking position.

There is also no further tightening of the quarters, in the skiing position, when the skier tends to flex the leg forwardly.

SUMMARY OF THE INVENTION

The aim of the present invention is therefore to eliminate the disadvantages described above in known types by providing a device for optimally closing the quarters of a ski boot of the rear-entry type and for allowing the skier to walk easily.

Within the scope of the above described aim, an important object is to obtain a device which achieves an automatic increase in the degree of tightening of the quarters, or of one or more pressers arranged inside the boot, when the skier flexes the leg forward.

Another important object is to provide a device which achieves a condition for easy walking in a rapid and simple manner without direct intervention on the conventional means, such as a lever, intended for tensioning the provided traction elements.

Another important object is to provide a device which associates with the preceding characteristics that of not altering the styling of the boot.

Another object is to provide a device which associates with the preceding characteristics that of being structurally simple as well as reliable and safe in use.

Not least object is to obtain a device which associates with the preceding characteristics that of being easy to industrialize and of having modest costs.

This aim, these objects and others which will become apparent hereinafter are achieved by an adjustable closure device, particularly for ski boots constituted by at least three parts: a front quarter, a rear quarter and a shell, characterized in that it comprises a tensioning means for actuating at least one traction element, said at least one traction element connecting at least two of said parts of said ski boot, said at least two parts being in relative motion when a skier flexex his/her leg inside said boot, at least one of said quarters having a stop element for engaging said at least one quarter with said shell at least when said skier extends his/her leg, a release means being provided for releasing said stop element disengaging said at least one quarter from said shell and for setting said ski boot in a walking position, means being provided for an automatic further tensioning of said traction element when said skier flexes his/her leg forwardly.

BRIEF DESCRIPTION OF THE DRAWINGS

Further characteristics and advantages of the invention will become apparent from the detailed description of some embodiments, illustrated only by way of non-limitative example in the accompanying drawings, wherein.

DESCRIPTION OF THE PREFERRED EMBODIMENTS

Figure 1:
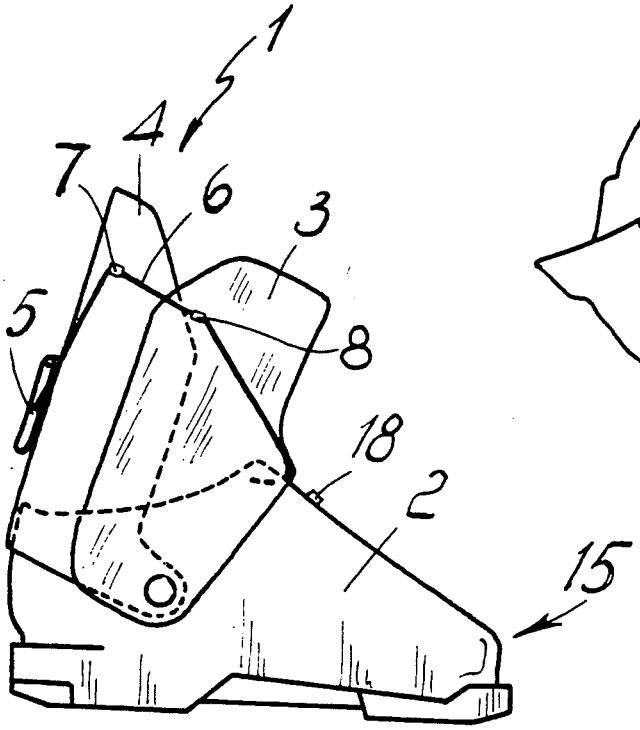
FIG. 1 is a schematic side view of a ski boot, according to the invention, with the quarters closed.
Figure 2:
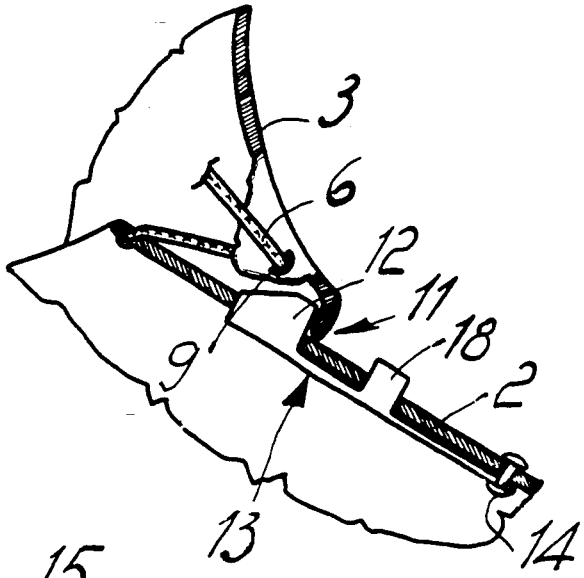
FIG. 2 is an enlarged partial sectional side view, according to a median plane which is longitudinal to the boot at the front perimetric edge of the front quarter, according to FIG. 1.
Figure 4:
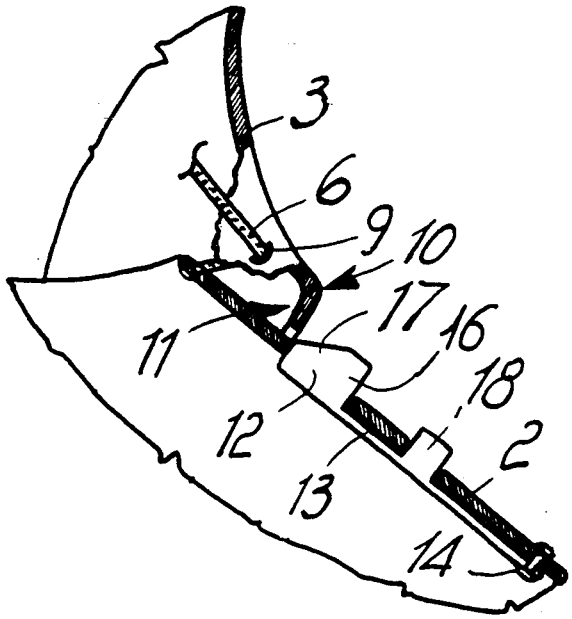
FIG. 4 is a view, similar to that of FIG. 2, of the boot in the position illustrated in FIG. 3.

With reference to the above figures, the reference numeral 1 indicates a ski boot having a front quarter 3 and a rear quarter 4 associated with a shell 2, and having an adjustable closure device.

The device comprises a tensioning means, such as a vertical lever 5, pivoted at the back of the rear quarter 4, and at least one traction element, such as a cable 6, associated with said tensioning means.

Said cable is connected to the vertical lever 5, then guided at a first guide member 7 on the rear quarter 4 and at a second guide member 8 on the front quarter 3, and is then inserted in said front quarter at an adpated opening 9 provided proximate to the front perimetric edge 10 of said front quarter 3.

As an alternative, the cable 6 can, after the second guide member 8, be inserted in the front quarter 3 and slidably associated with engagement means rigidly associated at the inner surface of said front quarter 3.

Figure 5:
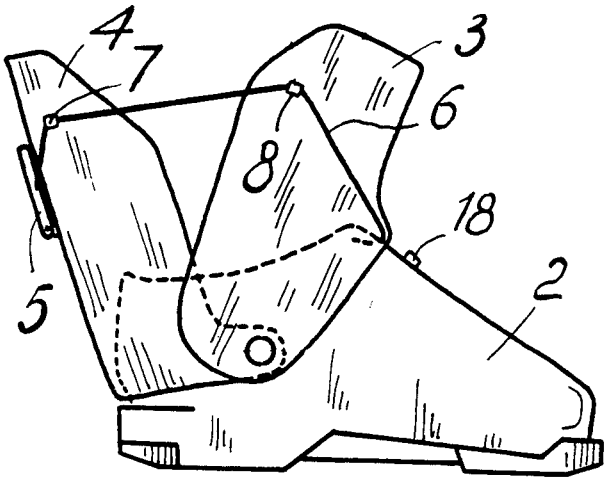
FIG. 5 is a view, similar to that of FIG. 1, of the boot in which the quarters are open.

Said cable 6 is locked, at the end arranged inside the front quarter 3, the underlying shell 2 in a point thereof which is in any case rearward with respect to the point of location of the opening 9, when the quarters are open as illustrated in FIG. 5.

A tooth 11 is furthermore provided at the front perimetric edge 10 of the front quarter 3 and temporarily interacts with a lug 12 which is located at the terminal end of a strip 13 which is arranged inside the shell 2 and is pivoted, at its other end, to said shell at an adapted pivot 14 directed toward the shell tip region 15.

Said lug 12 naturally protrudes externally to the shell through an adapted slot provided thereon, and has, in the direction of said region 15, a first surface 16 which protrudes perpendicularly to the shell 2 and, toward the front perimetric edge 10 of the front quarter 3, a second surface 17 which is inclined and has its vertex directed toward said front perimetric edge 10.

The strip 13 has, in the interspace comprised between the lug 12 and the end coupled to the shell at the pivot 14, a button 18 which protudes from the shell and can be activated directly by the skier.

The use of the device is therefore as follows: once the boot has been put on and vertical level 5 has been closed, the skier can achieve the final tensioning of the cable 6 by flexing the leg forward so as to move the tooth 11, which protrudes from the front perimetric edge 10 of the front quarter 3, to interact with the first surface 16 of the lug 12.

If the skier wishes to open the quarters completely it is sufficient to open the vertical lever 5, whereas if the skier wishes to obtain a position suitable for easy walking, and therefore obtain a partial opening of the quarters, it is sufficient to press the button 18 to allow the disengagement of the tooth 11 from the lug 12.

Figure 3:
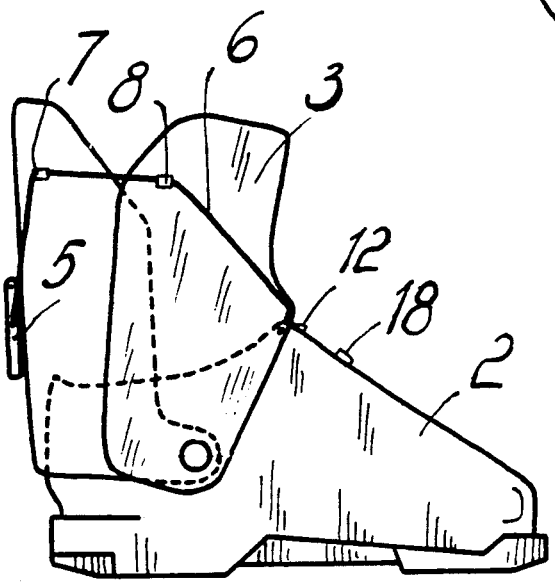
FIG. 3 is a view, similar to that of FIG. 1, of the boot with the quarters half-open in the walking position.

In this manner, without intervening on the vertical lever 5, it is possible to achieve the configuration illustrated in FIG. 3, in which though the quarters are closed the rear one is arranged approximately perpendicular so as to allow optimum walking; furthermore, the degree of tightening of the quarters is reduced due to the arrangement of the cable.

While skiing, the skier's possible further forward flexing furthermore entails, by virtue of the cable 6 being guided at the opening 9, a further tensioning thereof which therefore leads for example to an increased tightening of the quarters.

It has thus been observed that the invention has achieved the intended aim and objects, a device having been provided which allows to achieve the optimum closure of the quarters of a ski boot of the rear-entry type and at the same time allows the skier to walk easily.

The walking position can be achieved in a rapid and easy manner by the skier, since it is merely necessary to depress the button 18; at the same time, it is also easy to return to the condition in which the quarters are closed, since it is merely necessary to flex the leg forward so as to move the tooth 11 to interact with the first surface 16 of the lug 12.

The device is furthermore structurally very simple and easy to industrialize.

The device, according to the invention, is naturally susceptible to numerous modifications and variations, all of which are within the scope of the same inventive concept.

Figure 6:
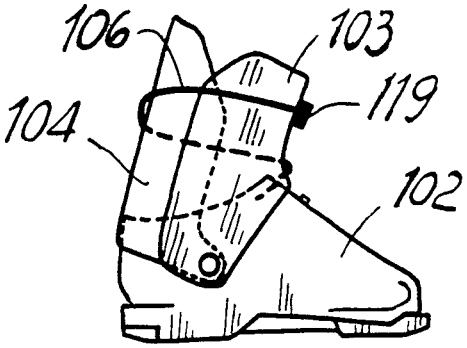
FIG. 6 is a schematic side view of a ski boot according to a further aspect of the invention, wherein the traction element and the tensioning means for said element are positioned differently.
Figure 7:
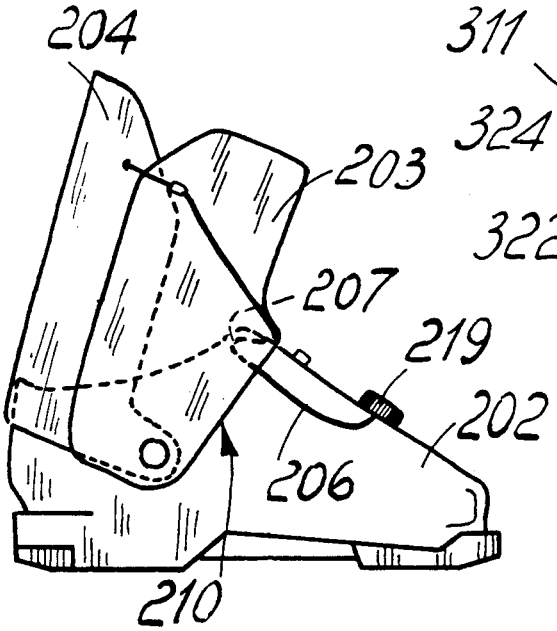
FIG. 7 is a schematic side view of still a further embodiment of the invention.

Thus, for example, as illustrated in FIG. 6, the tensioning means can be constituted by a circular winding device 119, for example associated with the front quarter 103; the cable 106 embraces the rear quarter 104, is then guided inside the front quarter 103 and is rigidly associated, at its end, with the underlying sheel 102.

As an alternative, it is possible to use a circular winding device 219 associated with the shell 202, and the cable 206 is caused to pass externally to the shell 202 in the region underlying the front perimetric edge 210 of the front quarter 203, then affects a guide member 207 provided on the shell 202, exists externally to the front quarter 203, is then guided to the rear quarter 204 and locked thereat.

Figure 8:
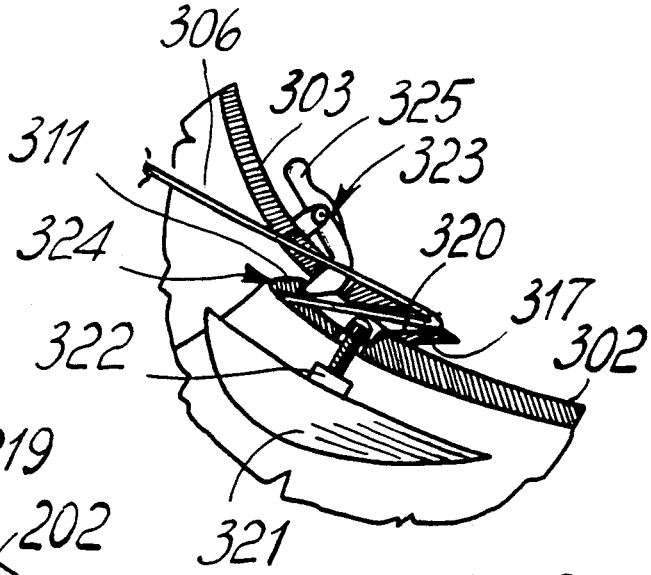
FIG. 8 is a view, similar to that of FIG. 2, of a further embodiment of the invention.

In FIG. 8, the front perimetric edge of the front quarter 303 has an inclined surface 317 which interacts, during forward flexing, with the end of a pin 320 which protrudes externally to the shell 302 and is connected, inside said shell, to an adpated presser 321.

The inclination of the surface 317 is such as to facilitate said movement of said pin.

An optional adjustment of th presser with respect to the inner lateral surface of he shell 302 can be achieved by associating therewith a block 322 which is internally threaded complementarily to the pin 320.

In order to obtain a rearward hold of the quarters, a pawl 323 is provided on the front quarter 303 and one of its ends interacts with a complementarily shaped tooth 311 which protrudes from the upper perimetric edge 324 of the underlying shell 302.

An adapted lever 325 can be connected to the hook 323 for its manual disengagement.

In this case, too, the cable 306 naturally passes from the outside of the front quarter 303 to the inside thereof and is connected, at its end, to the underlying shell 302 proximate to the upper perimetric edge 324 thereof.

Figure 9:
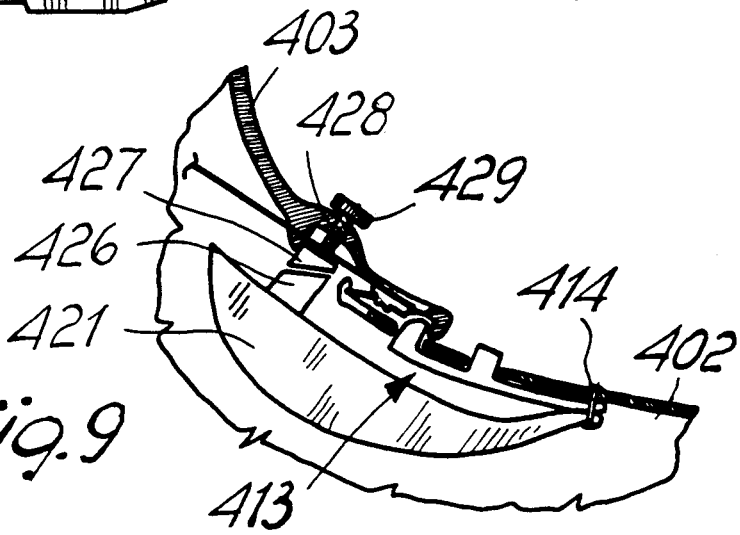
FIG. 9 is a view, similar to the preceding one, of still a further embodiment.

FIG. 9 illustrates a further embodiment in which the pivot 414, with which an end of the strip 413 is associated, also locks the end of a presser 421 from which a projection 426 protrudes on the opposite side and toward the overlying front quarter.

Said projection has, at its free end, an inclined surface which interacts with a complementarily shaped surface of a plate 427 which is movable perpendicularly to the overlying front quarter 403 by means of an adapted threaded stem 428 which is associated with a complementarily threaded seat defined on the front quarter and externally provided with a head 429 which can be actuated by the skier.

The arrangement of the inclined surfaces of the projection 426 of the plate 427 is such that a forward flexing of the skier's leg is followed by a lowering of the end of the presser 421 underlying said projection 426.

The materials and dimensions of the individual components which constitute the device may also naturally be the most pertinent according to the specific requirements.

We claim:

1. An adjustable closure device particularly for rear entry ski boots comprising a shell, and a front quarter and a rear quarter both connected to said shell, said adjustable closure device comprising at least one traction element and a tensioning means, said tensioning means being connected to said ski boot and having connected thereto said at least one traction element for tensioning thereof, said front quarter defining a front perimetric edge positioned above said shell, said at least one traction element having at least one portion which is slidingly engages said front quarter at a first point substantially near said front perimetric edge thereof and which is connected to said shell at a second point, said second point being in a rearward position from said first point, whereby a forward flexing of said front quarter in use relative to said shell provides an automatic further tensioning of said at least one traction element due to a distancing of said first point from said second point.

2. Adjustable closure device according to claim 1, wherein said at least one traction element is connected between said front and rear quarters, said first point being an opening defined in said front quarter.

3. Adjustable closure device according to claim 1, wherein said ski boot further comprises a foot instep presser, said at least one traction element engaging said foot instep presser.

4. Adjustable closure device according to claim 1, wherein said at least one traction elememt is constituted by a cable, said tensioning means being constituted by a lever, said lever being pivoted to said rear quarter, said cable being guided by a first guide member provided on said rear quarter and by a second guided member provided on said front quarter.

5. Adjustable closure device according to claim 1, wherein said at least one traction element is constituted by a cable, said tensioning means being constituted by a circular winding device.

6. An adjustable closure device, particularly for rear entry ski boots comprising a shell, and a front quarter and a rear quarter both pivoted to said shell, said adjustable closure device comprising at least one traction element, a tensioning means, and a releasable locking means for temporarily locking in forward position said front quarter relative to said shell, said front quarter defining a front perimetric edge positioned above said shell, said tensioning means being connected to said ski boot and having connected thereto said at least one traction element for tensioning thereof, said at least one traction element having at least one end portion which slidingly engages said front quarter at a first point substantially near said front perimetric edge thereof and which is connected to said shell at a second point, said second point being in a rearward position from said first point, whereby a forward flexing of said front quarter in use relative to said shell provides an automatic further tensioning of said at least one traction element due to a distancing of said first point from said second point, and whereby a release actuation of said locking means allows a rearward movement of said quarters with respect to said shell for easy walking and further said rearward movement permits a partial tension release of said at least one traction element for improved comfort due to an approaching of said first and second points.

7. Adjustable closure device according to claim 6, wherein said at least one traction element is connected between said front and rear quarters, said first point being an opening defined in said front quarter.

8. Adjustable closure device according to claim 6, wherein said ski boot further comprises a foot instep presser, said at least one traction element engaging said foot instep presser.

9. Adjustable closure device according to claim 6, wherein said at least one traction element is constituted by a cable, said tensioning means being constituted by a lever, said lever being pivoted to said rear quarter, said cable being guided by a first guide member provided on said rear quarter and by a second guided member provided on said front quarter.

10. Adjustable closure device according to claim 6, wherein said at least one traction element is constituted by a cable, said tensioning means being constituted by a circular winding device.

11. Adjustable closure device according to claim 6, wherein said shell defines an upper perimetric edge, said releasable locking means comprising a tooth provided on said shell at said upper perimetric edge thereof and a lever and pawl means pivotally connected to said front quarter, said lever and pawl means comprising a pawl hook for engagement with said tooth.

12. An adjustable closure device, particularly for rear entry ski boots comprising a shell, and a front quarter and a rear quarter both pivoted to said shell, said adjustable closure device comprising at least one traction element, a tensioning means, a tooth means, and an engagement means, said front quarter defining a front perimetric edge positioned above said shell, said tooth means being connected to said front quarter substantially at said front perimetric edge thereof, said engagement means being provided on said shell, said tooth means being releasably lockable in said engagement means for at least temporarily locking in forward position said front quarter relative to said shell, said tensioning means being connected to said ski boot and having connected thereof, said at least one traction element for tensioning thereof, said at least one traction element having at least one end portion which slidingly engages said front quarter at a first point substantially near said first perimetric edge thereof and which is connected to said shell at a second point, said second point being in a rearward position from said first point, whereby a forward flexing of said front quarter in use relative to said shell provides an automatic further tensioning of said at least one traction element due to a distancing of said first point from said second point, and whereby a disengagement of said tooth means from said engagement means allows a rearward movement of said quarters with respect to said shell for easy walking and further said rearward movement permits a partial tension release of said at least one traction element for improved comfort due to an approaching of said first and second points.

13. Adjustable closure device according to claim 12, wherein said at least one traction element is connected between said front and rear quarters, said first point being an opening provided in said front quarter.

14. Adjustable closure device according to claim 12, wherein said ski boot further comprises a foot instep presser, said at least one traction element engaging said foot instep presser.

15. Adjustable closure device according to claim 12, wherein said at least one traction element is constituted by a cable, said tensioning means being constituted by a lever, said lever being pivoted to said rear quarter, said cable being guided by a first guide member provided on said rear quarter and by a second guided member provided on said front quarter.

16. Adjustable closure device according to claim 12, wherein said at least one traction element is constituted by a cable, said tensioning means being constituted by a circular winding device.

17. Adjustable closure device according to claim 12, wherein said engagement means comprises a strip pivoted to said shell at a tip region thereof, said strip being provided with a protruding lug for engaging with said tooth means, said lug defining a first surface which extends substantially perpendicularly to said shell and a second inclined surface arranged facing said front perimetric edge of said front quarter, said strip being furthermore provided with disengagement button means for pivoting said strip to disengage said tooth means from said lug.

18. Adjustable closure device according to claim 12, wherein said front perimetric edge is provided with an inclined surface, said ski boot further comprising a foot instep presser arranged inside said shell and a pin connected to said presser and which protudes from said shell, said inclined surface of said front perimetric edge being adapted to engage said pin.

19. Adjustable closure device according to claim 18, wherein said pin is provided with a threaded stem which interacts with a complementary threaded block associated with said presser.

20. Adjustable closure device according to claim 12, wherein said engagement means comprises a strip pivoted to said shell at a pivot at a tip region thereof, said strip being provided with a protuding lug for engaging with said tooth means, said lug defining a first surface which extends substantially perpendicularly to said shell and a second inclined surface arranged facing said front perimetric edge of said front quarter, said strip being furthermore provided with disengagement button means for pivoting said strip to disengage said tooth means from said lug, said ski boot further comprising a foot instep presser which is pivoted to said shell at said pivot, said presser being provided with a projection which protrudes from said shell towards said front quarter, said projection having an inclined surface which interacts with a complementary shaped surface of a plate which is movable approximately perpendicularly to said front quarter by means of a threaded stem accommodated in a complimentarily shaped hole defined in said front quarter, said threaded stem having a screw head operatable externally of said ski boot, whereby said inclined surfaces interact and lower said presser upon a forward flexing of said quarters upon use.

* * * * *